United States Patent [19]

Panson

[11] Patent Number: 4,738,747

[45] Date of Patent: Apr. 19, 1988

[54] PROCESS FOR ETCHING ZIRCONIUM METALLIC OBJECTS

[75] Inventor: Armand J. Panson, Pittsburgh, Pa.

[73] Assignee: Westinghouse Electric Corp., Pittsburgh, Pa.

[21] Appl. No.: 888,293

[22] Filed: Jul. 22, 1986

[51] Int. Cl.[4] ..... C23F 1/00

[52] U.S. Cl. ..... 156/642; 134/3; 134/10; 156/664

[58] Field of Search ..... 156/642, 664; 134/3, 134/10, 13, 41; 436/55; 422/62; 423/489, 81

[56] References Cited

U.S. PATENT DOCUMENTS 3,048,503 8/1962 Foote ..... 134/13 X
3,125,474 3/1964 Watkins ..... 134/3 X
3,933,544 1/1976 Haas ..... 156/642
4,105,469 8/1978 Megy ..... 134/3

FOREIGN PATENT DOCUMENTS 2828547 1/1980 Fed. Rep. of Germany .

*Primary Examiner*—Kenneth M. Schor
*Attorney, Agent, or Firm*—R. A. Stoltz

[57] ABSTRACT

A process for etching zirconium metallic articles using an aqueous bath of hydrofluoric acid and nitric acid wherein the active hydrofluoric and nitric acid contents of the bath are determined by measurement of the dissolved zirconium content of the bath, and the bath is replenished in acid to give substantially the active hydrofluoric acid concentration and ratio to nitric acid, without removal of dissolved zirconium from the bath, to increase the bath etching life.

5 Claims, 2 Drawing Sheets

Zircaloy-4 etch rate vs bath loading.

Equilibrium constants vs number of complexed fluorine atoms.

$K_n$: $ZrF_{n-1}^{(3-n)+} + HF = ZrF_n^{(4-n)+} + H^+$

Zirconium fluorides ion distribution diagram.

Zirconium fluorides average number of fluorine atoms. N vs $HF/HNO_3$ ratio.

Zirconium fluorides average ionic charge. C vs $HF/HNO_3$ ratio

Zircaloy-4 etch rate vs bath loading.

PROCESS FOR ETCHING ZIRCONIUM METALLIC OBJECTS

FIELD OF THE INVENTION

A process for etching of zirconium or zirconium alloy articles wherein the etching bath of hydrofluoric acid and nitric acid is regenerated without removal of dissolved zirconium therefrom. A determination of the ratio of active hydrofluoric acid to nitric acid in an exhausted bath is made and replenishment thereof with fresh said acids is made to return the bath to the initial or fresh active hydrofluoric acid concentration and acid bath ratio, and increase the production of the bath.

BACKGROUND OF THE INVENTION

In the development of components of zirconium, such as in the formation of nuclear fuel cladding for use in containing fuel in a pressurized water reactor or boiling water reactor, the zirconium or zirconium alloy articles must be carefully formed to detailed specifications. In formation of nuclear fuel clad tubing, for example, an initial zirconium alloy tube is pilgered a number of times to reduce the size thereof and provide properties and sizes to specifications. A significant part of the formation of such clad tubing is the etching of the tube to remove defects from the tubing surface, especially the inside surface, which will confront the nuclear fuel, and also to increase the inside diameter of the clad tubing to specified dimensions. Such etching steps are generally used after each of three pilgering stages and twice after the final pilger mill pass. Especially useful zirconium alloys used in formation of nuclear fuel cladding and other components of nuclear reactors are those known as Zircaloy −2 and Zircaloy −4. Zircaloy −2 contains, by weight, about 1.2 to 1.7 percent tin, 0.07 to 0.20 percent iron, 0.05 to 0.15 percent chromium, and about 0.03 to 0.08 percent nickel, the balance being zirconium, while Zircaloy −4 contains, by weight, about 1.2 to 1.7 percent tin, 0.12 to 0.18 percent iron, and 0.05 to 0.15 percent chromium, the balance being zirconium.

In the etching of zirconium or zirconium alloy articles, it is known to use aqueous hydrofluoric acid–nitric acid baths. In the etching of tubes, for example, tubes are immersed in an aqueous bath containing hydrofluoric acid, preferably in an amount by weight of 3 percent, and nitric acid, preferably in an amount by weight of 15 percent, until the required surface cleaning and polishing of the article is obtained. Etch rates of the baths decrease with use until a limiting rate of about 20 percent of the fresh or initial bath rate is reached. At this stage the spent baths, which generally contain about 24 g/l of dissolved zirconium alloy, are discarded. The spent etching baths must then be treated to render them disposable and the baths discarded, an expensive procedure. The spent baths contain, among other components, various zirconium compounds or complexes, some tin components, when Zircaloys are etched, residual hydrofluoric acid and residual nitric acid.

Various attempts have previously been made to regenerate or replenish hydrofluoric acid–nitric acid baths used in treating zirconium articles. In U.S. Pat. No. 4,105,469, a pickle acid bath for cleaning zirconium is generated by adding sodium fluoride to a spent hydrofluoric acid–nitric acid pickle liquor to precipitate zirconium fluoride therefrom. The addition of the sodium fluoride is measured to precipitate sodium hexafluoro zirconate to produce a pickle liquor containing from 3–7 grams zirconium per liter. Hydrofluoric acid is added to make up for the amount of acid used in pickling and, when necessary, nitric acid is added to bring the solution up to the pickling concentrations. The spent pickle liquor is removed from pickling tanks and the sodium fluoride added in separate tanks, with the acids also added in separate tanks. In U.S. Pat. No. 3,048,503, titanium or zirconium sheets are pickled by introducing them into a circulating body of aqueous pickle liquor containing 2–4 percent hydrofluoric acid and 15–30 percent nitric acid. The sheets are passed countercurrent to a flow of the pickle liquor, with partially spent pickle liquor withdrawn, cooled to precipitate metal values, metal values separated, and the hydrofluoric acid–nitric acid concentration of the spent pickle liquor adjusted, with the liquor then returned to the bath. German patent disclosure No. 2828547 describes a process for controlling the composition of a pickling bath for zirconium where a partial volume of the bath is withdrawn, the metal in the partial volume precipitated to form a difficult to dissolve compound, and the concentration of the compound determined in dilution by turbidity measurement. The bath is then regenerated by adding fresh hydrofluoric acid–nitric acid solutions to the bath while a like volume of used pickle liquor is drawn off from the bath.

It is an object of the present invention to regenerate an aqueous hydrofluoric acid–nitric acid etching bath for zirconium metallic articles so as to extend the life of said bath, while achieving acceptable etching rates.

It is another object of the present invention to regenerate an aqueous hydrofluoric acid–nitric acid etching bath for zirconium metallic articles without the need to precipitate and remove dissolved zirconium material from said bath.

SUMMARY OF THE INVENTION

A process for etching of zirconium metallic articles by use of a hydrofluoric acid–nitric acid bath, whereby the life of a bath is increased, by determining the ratio of active hydrofluoric acid to active nitric acid in an exhausted bath after etching of zirconium articles therein and adding hydrofluoric acid and nitric acid to the bath in an amount to adjust the ratio of active hydrofluoric acid to nitric acid therein to a value substantially that of the initial ratio of the fresh bath, and to restore the active hydrofluoric acid concentration, to regenerate the bath, without removal of dissolved zirconium for the bath. Further zirconium metallic articles may then be etched in the regenerated bath.

DESCRIPTION OF THE INVENTION

Figure 1:
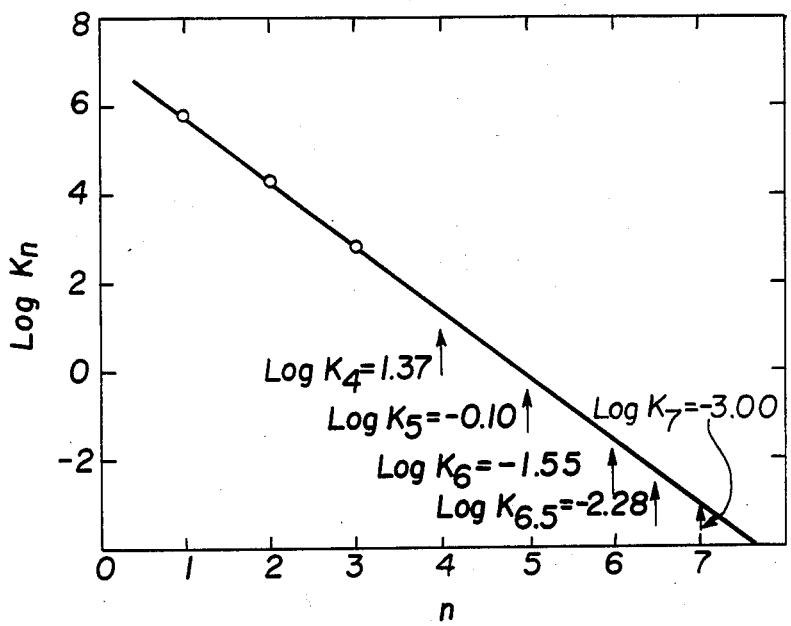
FIG. 1 is a plot of log (K) of equilibrium constants versus the number of complexed fluoride atoms in an aqueous hydrofluoric acid–nitric acid zirconium etching bath.

The present process provides a means for extending the life of an etching bath of hydrofluoric acid and nitric acid for etching of zirconium metal articles without the need for removal of dissolved zirconium from the bath solution.

The etching of zirconium metal articles, such as articles formed from zirconium or a zirconium alloy by the use of an aqueous bath containing hydrofluoric acid and nitric acid is known. Generally, the aqueous bath contains 2 to 4 percent by weight hydrofluoric acid and 12 to 35 percent by weight of nitric acid, with an especially useful aqueous bath containing 3 percent by weight hydrofluoric acid and 15 percent by weight nitric acid.

Upon contact of the zirconium metal article with the etching bath, metallic components, particularly zirconium metal in ionic or complex form are dissolved in the bath and nitric acid and hydrofluoric acid are chemically reacted such that the activity of the bath diminishes and the bath must be either regenerated or discarded and fresh etching solution provided.

In the present process, an exhausted etching bath is regenerated without the need to remove dissolved zirconium therefrom by measurement of the zirconium content, and determination of the active ratio of hydrofluoric acid to nitric acid in the bath, and adding hydrofluoric acid and nitric acid to the exhausted bath to adjust the ratio thereof to a value substantially that of the initial ratio, and active concentration.

In etching of zirconium articles, such as Zircaloy −4 nuclear fuel cladding tubing, etching is used for surface polishing and also to increase the inside diameter of the tubing. Current etching baths for such articles can use horizontal unstirred etching baths that contain an aqueous solution of 3 percent by weight hydrofluoric acid and 15 percent by weight nitric acid. The Zircaloy −4 tubes are immersed in the bath for a predetermined period of time, with the immersion duration increased for a given increase of inside diameters of the tubes due to the exhaustion of bath strength with use. The exhaustion of the bath has been determined to occur when the etching solution contains about 24 g/l of zirconium.

In the present process, the activity of an exhausted hydrofluoric acid–nitric acid etching bath for zirconium articles is increased to give an increase in bath utilization by restoring both hydrofluoric acid and nitric acid activity lost from the etching solution during etching. Zirconium is not removed from the solution. In order to establish stoichiometric relations necessary to calculate amounts of nitric and hydrofluoric acid needed to restore the reactivity of an etching bath for etching of zirconium, the chemical reactions taking place during etching must be reviewed.

Oxidation of the metal by the nitric acid–hydrofluoric acid mixtures can result from a reduction of protons to form hydrogen and/or reduction of nitrate ions to form nitric oxide as the metallic zirconium is oxidized to the tetravalent state. The following reactions describe these processes:

OXIDATION $$Zr + 4H^+ = Zr^{4+} + 2H_2 \quad (1)$$

$$3Zr + 4NO_3^- + 16H^+ = 3Zr^{4+} + 4NO + 8H_2O \quad (2)$$

Both oxidation reactions can occur simultaneously or singly with varying relative importance depending on the conditions. Most likely the critical parameter is the ratio of available hydrofluoric and nitric acids. While hydrogen evolution clearly is involved, recent electrochemical investigations have shown that reduction of nitrate is important. Accordingly, until more detailed information on the oxidation reactions is obtained, oxidation will be attributed entirely to nitrate reduction. Thus stoichiometric relations needed to determine nitric acid depletion during the course of the etching reaction are derived from reaction (2). This equation then shows that 4/3 mole of nitric acid reacts in the dissolution of each mole of zirconium. In an experimental study of acidity decrease associated with dissolution of Zircaloy −4, a value of about 5/3 was determined by titration with sodium hydroxide. This value of 5/3 was accordingly used in subsequent acid restoration experiments.

Following oxidation, reaction with fluoride ion to form zirconium fluoride complexes occurs. The problem is that detailed information on the chemistry of these compounds is not avaliable in the literature. Free energies, or equilibrium contents for the reactions have not been published. This information is essential to calculate the chemical change taking place in the etch bath as the bath becomes depleted.

Equilibrium constants for the formation of $ZrF^{3+}$, $ZrF_2^{2+}$, and $ZrF_3^+$ have been determined based on solvent extraction studies and published (R. E. Connick and W. H. McVey, "The Aqueous Chemistry of Zirconium", J. Am. Chem. Soc. 71: 3182–3191, 1949). Yet the fluoride complex chemistry of zirconium is a good bit more involved than these three complexes. A phase diagram for the system $ZrF_4$, NaF, $H_2O$ has been published (I. V. Tananaen and L. S. Guzeeva, "The $Zr_4$—NaCK, Rb, Cs) F—$H_2O$ Systems", Russ. J. Inorg. Chem. 11: 590–593, 1966) showing clear evidence for the solid phases, $NaZrF_5H_2O$, $Na_2ZrF_6$, $Na_5Zr_2F_{13}$, $Na_3ZrF_7$. The zirconium fluoride complex ions in the etch bath are considered to include the ionic species suggested by these papers and to form according to the following reactions:

COMPLEX FORMATION $$Zr^{4+} + HF = ZrF^{3+} + H^+ \ (K1 = 6.3 \times 10^5) \quad (3)$$

$$ZrF^{3+} + HF = ZrF_2^{2+} + H^+ \ (K2 = 2.10 \times 10^4) \quad (4)$$

$$ZrF_2^{2+} + HF = Zr_3^+ + H^+ \ (K3 = 6.7 \times 10^2) \quad (5)$$

$$ZrF_3^+ + HF = ZrF_4 + H^+ \quad (6)$$

$$ZrF_4 + HF = ZrF_5^- + H^+ \quad (7)$$

$$ZrF_5^- + HF = ZrF_6^{2-} + H^+ \quad (8)$$

$$ZrF_6^{2-} + 0.5HF = ZrF_{6.5}^{2.5-} + 0.5H^+ \quad (9)$$

$$ZrF_{6.5}^{2.5-} + 0.5HF = ZrF_7^{3-} + 0.5H^+ \quad (10)$$

K represents the equilibrium constants for the reactions.

In order to calculate the chemical composition of the etch baths, it is necessary to obtain the equilibrium constants for reactions (6)–(10). To do this, an assumption was made that a constant incremental change in free energy is involved for the complexation reaction of each additional fluoride ion. The necessary equilibrium constants then can be calculated based on the constants for reactions (3)–(5). The free energy, $\Delta G$ is proportional to log (K) since $$\Delta G = -RT \log (K)$$

Thus, a plot of log (K) versus the number of fluoride ions complexed, n, should be linear and from it values the unknown equilibrium constants can be determined.

FIG. 1 shows this plot is linear for n=1, 2, and 3. Accordingly, values for the remaining equilibrium constants were determined. Table 1 shows the results.

TABLE I

| $\log(K_n)$ for: $ZrF_{n-1}^{(5-n)+} + HF = ZrF_n^{(4-n)+} + H^{4+}$ | |
|---|---|
| n | $\log(K_n)$ |
| 1 | 5.8 |
| 2 | 4.32 |
| 3 | 2.83 |
| 4 | −0.10 |
| 6 | −1.55 |
| 6.5 | −2.28 |
| 7 | −3.00 |

The chemistry can now be determined by calculating the mole fraction, alpha-n for each complex species $ZrF_n^{(4-n)+}$ as a function of the ratio of $HF/HNO_3$, R. The equations are:

$$[Zr_T] = \left[1 + \sum_{n-1}^{7} R^n \left[\prod_{i=1}^{n} \pi Ki\right]\right][Zr^{4+}]$$

$$a_o = \frac{[Zr^{4+}]}{Zr_T} = \left[1 + \sum_{n=1}^{7} R^n \left(\prod_{i=1}^{n} \pi Ki\right)\right]^{-1}$$

$$a_n = \frac{\left[R^n \prod_{i=1}^{n} \pi Ki\right]}{[Zr_T]} [Zr^{4+}]$$

$$N = \sum_{i=0}^{7} na_i$$

$$C = \sum_{i=0}^{7} c_i a_i$$

Figure 2:
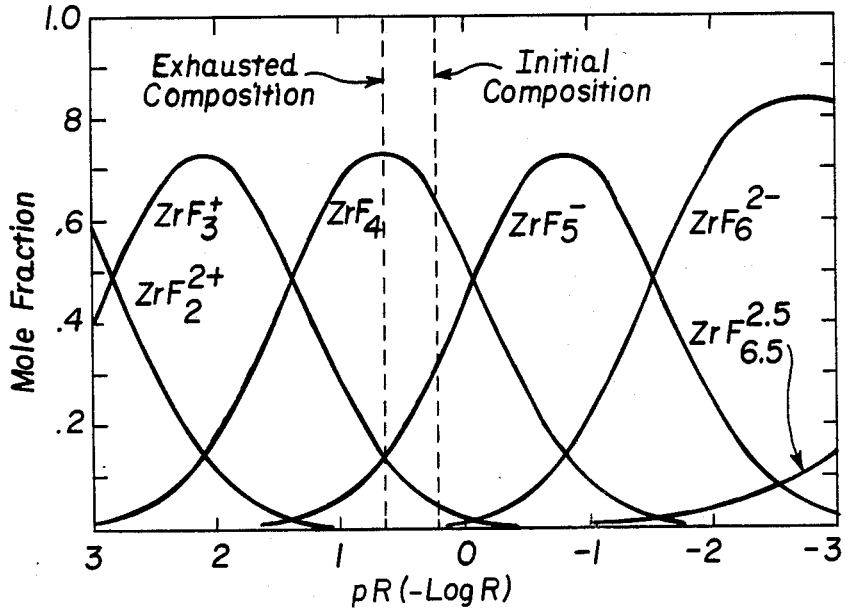
FIG. 2 is an ion distribution diagram showing zirconium fluorides in an aqueous hydrofluoric acid–nitric acid zirconium etching bath.

$[Zr_T]$ = total zirconium concentration
$R$ = ratio of $HF/HNO_3$ concentration
$K_i$ = equilibrium constant for species $i$
$N$ = average number of fluorine atoms complexed with zirconium
$a_i$ = mole fraction of species $i$
$n$ = number of fluoride atoms on species $i$
$C$ = average charge of zirconium ions
$c$ = charge on species $i$ FIG. 2 presents the ion distribution diagram calculated in this way. In FIG. 2, values for the fresh and exhausted bath ratios are shown for an immersion etching process which uses a 3 percent hydrofluoric acid–15 percent nitric acid aqueous etch bath compositions by weight.

Values for the fresh and exhausted etch bath ratios are shown for the present immersion etch process which uses a 3% HF–15% $HNO_3$ etch bath composition by weight. It is highly significant that the solutions ratio for the exhausted bath occurs at the maximum concentration for the uncharged complex, $ZrF_4$. This is because a solubility minimum occurs at this point. The net charge of all the zirconium complexes in the solution is zero and an expression for the equilibrium solubility of $ZrF_4$ has a value of zero for its derivative with respect to R here.

Figure 3:
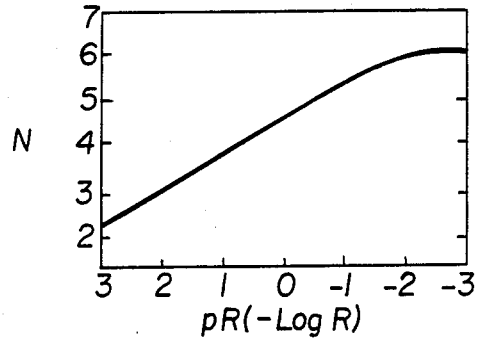
FIG. 3 illustrates the average number of fluoride ions associated with each zirconium N, calculated as a function of R.
Figure 4:
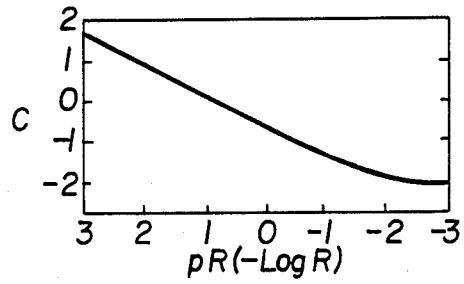
FIG. 4 illustrates the average ionic charge of zirconium fluorides, C versus $HF/HNO_3$ ratio.

The average number of fluoride ions associated with each zirconium N was calculated as a function of R and is presented in FIG. 3. The net charge, C on the zirconium species in solution was calculated as a function of R and is shown in FIG. 4.

With these calculations there is now enough information on the ionic composition of the etch bath solution to calculate the decrease in active fluoride composition and also the decrease in nitric acid associated with dissolution of zirconium during etching. This is the data needed to restore the initial fluoride and nitric acid activity of the bath. Table 2 presents the change of R and N as zirconium is dissolved during the course of etching. The active ratio changes during the etching reaction as a consequence of complexation or bonding of fluoride ions to zirconium, and also due to the reduction of nitrate ion. The relationship is:

$$R = \frac{[HF] - N[Zr_T]}{[HNO_3]_i - 5/3[Zr_T]}$$

where $[HF]_i$ is the initial concentration of HF in the bath, $[HNO_3]_i$ is the initial concentration of $HNO_3$ in the bath, 5/3 is the number of moles of nitric acid reduced during dissolution of each mole of zirconium, and $N[Zr_T]$ is the molar concentration of dissolved zirconium in the used bath. To restore R after reaction, the active concentration of hydrofluoric acid is increased or spiked by a molar amount equal to $N[Zr_T]$, i.e. by the average number of fluoride ions times the total molar zirconium concentration dissolved. In the case of nitric acid, 5/3 times the molar quantity of dissolved zirconium is added. The stoichiometric value of 5/3 was arrived at experimentally by titrating loss of acidity associated with dissolution of zirconium. Note currently used baths are considered exhausted and are discarded when the zirconium concentration reaches 24 g/l. The calculations were carried out for an initial active composition of 3% HF and 15% $HNO_3$ by weight, a standard etch bath composition. The active concentration of hydrogen fluoride in the bath is meant to define that fluoride that is not already reacted with zirconium or other metals and would thus be available for reaction with zirconium.

Since the initial values for R and N are known, by measuring the dissolved zirconium content of the used etching bath, the amount of hydrofluoric acid and nitric acid needed to return the used or exhausted bath to the to the initial active concentration and ratio can then be determined. Measurement may be by titration or other means.

As an example, etch rates were determined for a 3 percent hydrofluoric acid–15 percent nitric acid bath first with no Zircaloy −4 dissolved and then to a level of 24 g/l, the value at a normal exhaustion point for the bath. Based on an exhaustion rate normalized to unity (1), the relative etch rate observed in the fresh bath was 4.65.

TABLE 2

Average Number of Fluoride Ions Complexed with Zirconium, N, and -log(R) = pR for Active Ratio of $HF/HNO_3$, R, Remaining in the Etch Bath. Initial Composition: 3% HF, 15% $HNO_3$ by Weight

| Zr (g) | R | pR | N |
|---|---|---|---|
| 0 | .62989 | .20074 | 4.28523 |
| 1 | .61311 | .21246 | 4.27709 |
| 2 | .59629 | .222454 | 4.26874 |
| 3 | .57943 | .23700 | 4.26015 |
| 4 | .56252 | .24986 | 4.25133 |
| 5 | .54558 | .26314 | 4.24224 |
| 6 | .52859 | .27688 | 4.23288 |
| 7 | .51157 | .29110 | 4.22324 |
| 8 | .49450 | .30583 | 4.21329 |
| 9 | .47740 | .32112 | 4.20301 |
| 10 | .46027 | .33699 | 4.19239 |
| 11 | .44310 | .35350 | 4.18139 |
| 12 | .42590 | .37069 | 4.16999 |
| 13 | .40868 | .38862 | 4.15815 |
| 14 | .39143 | .40735 | 4.14586 |
| 15 | .37416 | .42694 | 4.13305 |
| 16 | .35688 | .44748 | 4.11969 |
| 17 | .33959 | .46904 | 4.10573 |
| 18 | .32231 | .49173 | 4.09110 |
| 19 | .30504 | .51565 | 4.07575 |
| 20 | .28779 | .54093 | 4.05957 |
| 21 | .27058 | .56771 | 4.04250 |
| 22 | .25342 | .59615 | 4.02440 |
| 23 | .23635 | .62645 | 4.00516 |
| 24 | .21973 | .65882 | 3.98461 |
| 25 | .20254 | .69349 | 3.96256 |
| 26 | .18589 | .73075 | 3.93881 |
| 27 | .16946 | .77092 | 3.91309 |
| 28 | .15334 | .81435 | 3.88507 |
| 29 | .13759 | .86142 | 3.85442 |
| 30 | .12231 | .91255 | 3.82072 |
| 31 | .10761 | .96813 | 3.78354 |
| 32 | .09363 | 1.02851 | 3.74245 |
| 33 | .08055 | 1.09392 | 3.69712 |
| 34 | .06848 | 1.16441 | 3.64739 |
| 35 | .05757 | 1.23978 | 3.59335 |

Figure 5:
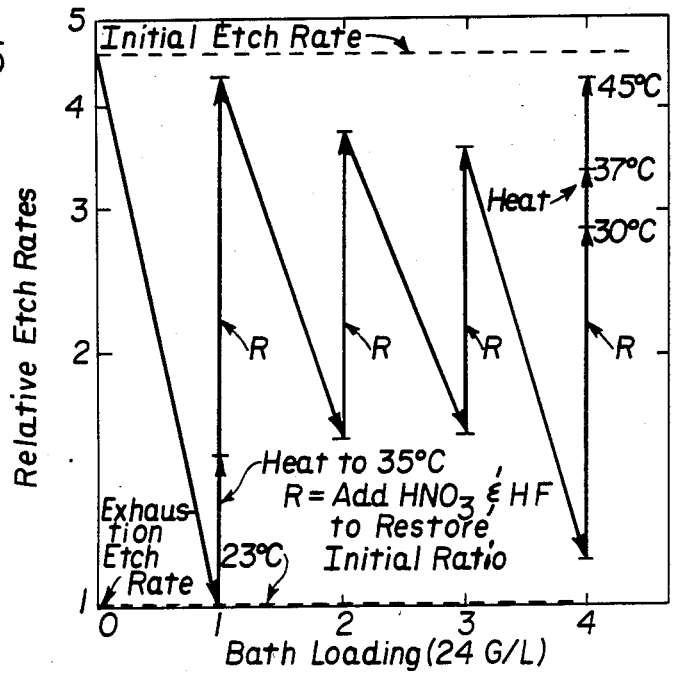
FIG. 5 illustrates a Zircaloy −4 etch rate versus bath loading for an aqueous hydrofluoric acid–nitric acid etching bath.

The dissolved zirconium content of an exhausted bath (24 g/l Zircaloy −4: etching of rate of (1) was measured, and there was added hydrofluoric acid and nitric acid calculated from the data of Table 2 to restore the initial acitve concentration of hydrofluoric acid and the initial acitve ratio, R. The bath temperature was raised from 27° C. to 35° C. and an etch rate redetermined. A relative ratio of 4.35 was measured. This is 94 percent of the rate observed for a fresh or unloaded bath (4.65). Dissolved zirconium contents and etch rates were then measured after a second, third and fourth increase in concentration by 24 g/l of Zircaloy −4 or loading. Following the fourth loading and regeneration, the temperature was increased from 30° C. to 37° C. and then to 45° C., and a relative etch rate of 4.35 was measured. At this stage, the bath contained 96 g/l Zircaloy −4 (4×24 g/l). This is to be compared with the normal exhaustion point of 24 g/l presently used. FIG. 5 shows these results.

After the solution stood at room temperature overnight, no precipitations were observed. After a fifth loading to 120 g/l at about 40° C., precipitation resulted on cooling.

The present process thus provides for the regeneration of a hydrofluoric acid–nitric acid bath without the need to remove dissolved zirconium therefrom with the etching rate of the regenerated bath substantially that of the initial bath. Such etching, as is conventional, is effected at atmospheric pressure and ambient temperature, although upon exothermic reaction of the acids with the metal, some increase in bath temperature will result. Temperatures between 20° C. and 50° C. are generally used. After about three or four regenerations of a single bath, a fresh bath may be needed, but the life of the initial etching bath was extended to three or four times that which was normal procedure.

What is claimed is:

1. In a process for etching of zirconium metallic articles formed from zirconium or a zirconium alloy, wherein said zirconium metallic article is contacted with an aqueous hydrofluoric acid–nitric acid etching bath having an initial ratio of hydrofluoric acid to nitric acid and an initial concentration of hydrofluoric and nitric acids, the improvement comprising:

after etching of zirconium metallic articles in said bath for a period of time such that the etching rate has diminished from an initial rate to a lesser rate, thus forming an exhausted etching bath containing dissolved zirconium, determining the active concentration of hydrofluoric acid and the ratio of active hydrofluoric acid to active nitric acid in said exhausted bath by measuring the dissolved zirconium content and the average number of fluoride ions bound to each zirconium ion in said bath and measuring the number of moles of nitric acid reduced during the dissolution of each mole of zirconium in said bath, wherein said average number of fluoride ions bound to each zirconium ion is a value N, the number of moles of nitric acid reduced during the dissolution of each mole of zirconium is 5/3, $[HF]_i$ is the initial concentration of HF in the bath, $[HNO_3]_i$ is the initial concentration of $HNO_3$ in the bath, and $[Zr_T]$ is the molar concentration of dissolved zirconium in the exhausted bath, and wherein the active ratio of hydrofluoric acid to nitric acid in said exhausted bath, R, is determined by solving the equation:

$$R = \frac{[HF]_i - N[Zr_T]}{[HNO_3]_i - 5/3[Zr_T]}$$

adding hydrofluoric acid and nitric acid to said exhausted bath to adjust the concentration and ratio of hydrofluoric acid to nitric acid therein to a value substantially that of said initial concentration and ratio and thereby regenerate said etching solution without removal of dissolved zirconium therefrom; and etching further zirconium metallic articles in the regenerated etching bath.

2. The process for etching of zirconium metallic articles as defined in claim 1 wherein said regeneration is effected at least three times on a single etching bath, without removal of dissolved zirconium therefrom.

3. The process for etching zirconium metallic articles as defined in claim 2 wherein said metallic articles comprise nuclear fuel clad tubing composed of, by weight, about 1.2 to 1.7 percent tin, 0.12 to 0.18 percent iron, and 0.05 to 0.15 percent chromium, the balance being essentially zirconium.

4. The process for etching zirconium metallic articles as defined in claim 1 wherein said article is composed of, by weight, about 1.2 to 1.7 percent tin, 0.12 to 0.18 percent iron, and 0.05 to 0.15 percent chromium, the balance being essentially zirconium.

5. The process for etching zirconium metallic articles as defined in claim 1 wherein said article is composed of, by weight, about 1.2 to 1.7 percent tin, 0.07 to 0.20 percent iron, and 0.05 to 0.15 percent chromium, and about 0.03 to 0.08 percent nickel, the balance being essentially zirconium.

* * * * *